US008834525B2

(12) United States Patent
Thornton et al.

(10) Patent No.: US 8,834,525 B2
(45) Date of Patent: Sep. 16, 2014

(54) MOOD PACIFIER

(76) Inventors: Cara L. Thornton, Clearwater, FL (US); Gary Thornton, Clearwater, FL (US)

( * ) Notice: Subject to any disclaimer, the term of this patent is extended or adjusted under 35 U.S.C. 154(b) by 911 days.

(21) Appl. No.: 10/429,394

(22) Filed: May 5, 2003

(65) Prior Publication Data

US 2003/0208234 A1 Nov. 6, 2003

Related U.S. Application Data

(60) Provisional application No. 60/377,882, filed on May 3, 2002.

(51) Int. Cl.
*A61J 17/00* (2006.01)

(52) U.S. Cl.
CPC ..... *A61J 17/00* (2013.01); *A61J 2017/003* (2013.01)
USPC ..... 606/234

(58) Field of Classification Search
CPC ..... A61J 17/00; A61J 17/001; A61J 17/003; A61J 2017/00
USPC ..... 606/234, 235, 236; 222/490; 374/151
See application file for complete search history.

(56) References Cited

U.S. PATENT DOCUMENTS

| | | | | | |
|---|---|---|---|---|---|
| 3,782,194 | A | * | 1/1974 | Brodie et al. | 374/151 |
| 3,802,945 | A | * | 4/1974 | James | 428/1.5 |
| 3,913,402 | A | * | 10/1975 | Doyle | 374/151 |
| 3,935,743 | A | * | 2/1976 | Brodie et al. | 374/151 |
| 4,198,920 | A | * | 4/1980 | Russell | 116/202 |
| 4,447,164 | A | * | 5/1984 | Berndt | 374/162 |
| 4,511,265 | A | * | 4/1985 | Berndt | 374/151 |
| 4,653,933 | A | * | 3/1987 | Reichel | 368/282 |
| 5,013,160 | A | * | 5/1991 | Massey et al. | 374/151 |
| 5,021,060 | A | * | 6/1991 | Lu | 606/234 |
| 5,033,864 | A | * | 7/1991 | Lasecki et al. | 374/151 |
| 5,176,704 | A | * | 1/1993 | Berndt | 606/234 |
| 5,186,047 | A | * | 2/1993 | Gordon et al. | 374/151 |
| 5,534,013 | A | * | 7/1996 | Zeindler | 606/234 |
| 5,581,238 | A | * | 12/1996 | Chang et al. | 340/573.1 |
| 5,743,648 | A | * | 4/1998 | Zeindler | 374/151 |
| 5,782,561 | A | * | 7/1998 | Pai | 374/151 |
| 5,873,892 | A | * | 2/1999 | Cohen | 606/234 |
| 2009/0198275 | A1 | * | 8/2009 | Godown et al. | 606/236 |
| 2011/0046671 | A1 | * | 2/2011 | Okoturo | 606/236 |
| 2012/0277794 | A1 | * | 11/2012 | Kountotsis et al. | 606/234 |

OTHER PUBLICATIONS

Chemical of the Week: Liquid Crystals; www.scifun.chem.wisc.edu/liqxtal/liqxtal.html; printed May 3, 2004; included to explain the properties of liquid crystals.*

Pacifier Thermometer and Medicine Dispenser; http://www.amazon.com/exec/obidos/tg/detail/-/B00009QMQA/103-8806662-7388608?v=glance; Apr. 3, 2004; included to show another example of a pacifier with a temperature sensitive material.*

The First HP Liquid Crystal Display: www.hpmuseum.org/journals/hp41/411cd.htm; printed Apr. 3, 2004; printed to explain the properties of liquid crystal.*

* cited by examiner

*Primary Examiner* — Dianne Dornbusch
(74) *Attorney, Agent, or Firm* — Zarley Law Firm, P.L.C.

(57) ABSTRACT

An infant pacifier has a temperature sensitive material mounted on the front forming a "mood stone". The front of the pacifier would change color based on the body temperature of the infant using the pacifier. The pacifier includes a metal strip or other temperature conductive material that connects to the metal frame of the mood stone and wraps around to come in contact with the baby's lips when the baby is sucking on the pacifier. The metal strip carries the heat from the baby to the stone, facilitating color change as the child's temperature changes.

13 Claims, 2 Drawing Sheets

MOOD PACIFIER

CROSS-REFERENCE TO OTHER APPLICATIONS

This application claims the benefit of U.S. Provisional Patent Application No. 60/377,882, filed May 3, 2002, the specification of which is hereby incorporated by reference.

FIELD OF THE INVENTION

The present invention relates to an infant pacifier that features a mood stone, i.e., an item that changes color based on temperature.

BACKGROUND OF THE INVENTION

Many infants use pacifiers on a regular basis. Most pacifiers are purely functional, with the front of the pacifier (i.e., the part facing outward from the baby's mouth) being very basic in design.

Since pacifiers are used so often, it would be of benefit to the people who see the baby if the pacifier had some sort of visual appeal.

SUMMARY OF THE INVENTION

The present invention is formed of an infant pacifier, constructed of plastic, rubber, or other non-toxic material, which has a "mood stone" on the front. The mood stone is made of a substance that changes color based on the body temperature, which controls the temperature of the substance. The substance used could be the material made commercially for products such as the Mood Rings of the 1970's. The front of the pacifier would change color based on the body temperature of the infant using the pacifier, thereby making interesting visual appeal for those around the baby. While the mood stone cannot be used to evaluate or predict the actual mood of the child, it is interesting to look at and may also be viewed as a conversation piece.

The pacifier may include a metal strip or other temperature conductive material that connects to a metal frame surrounding the perimeter of the mood stone. The metal strip passes through the material of the base to come in contact with the baby's lips when the baby is sucking on the pacifier. The metal strip assists in carrying the heat from the baby to the stone, facilitating color change as the child's temperature changes.

DETAILED DESCRIPTION OF THE INVENTION

Figure 1:
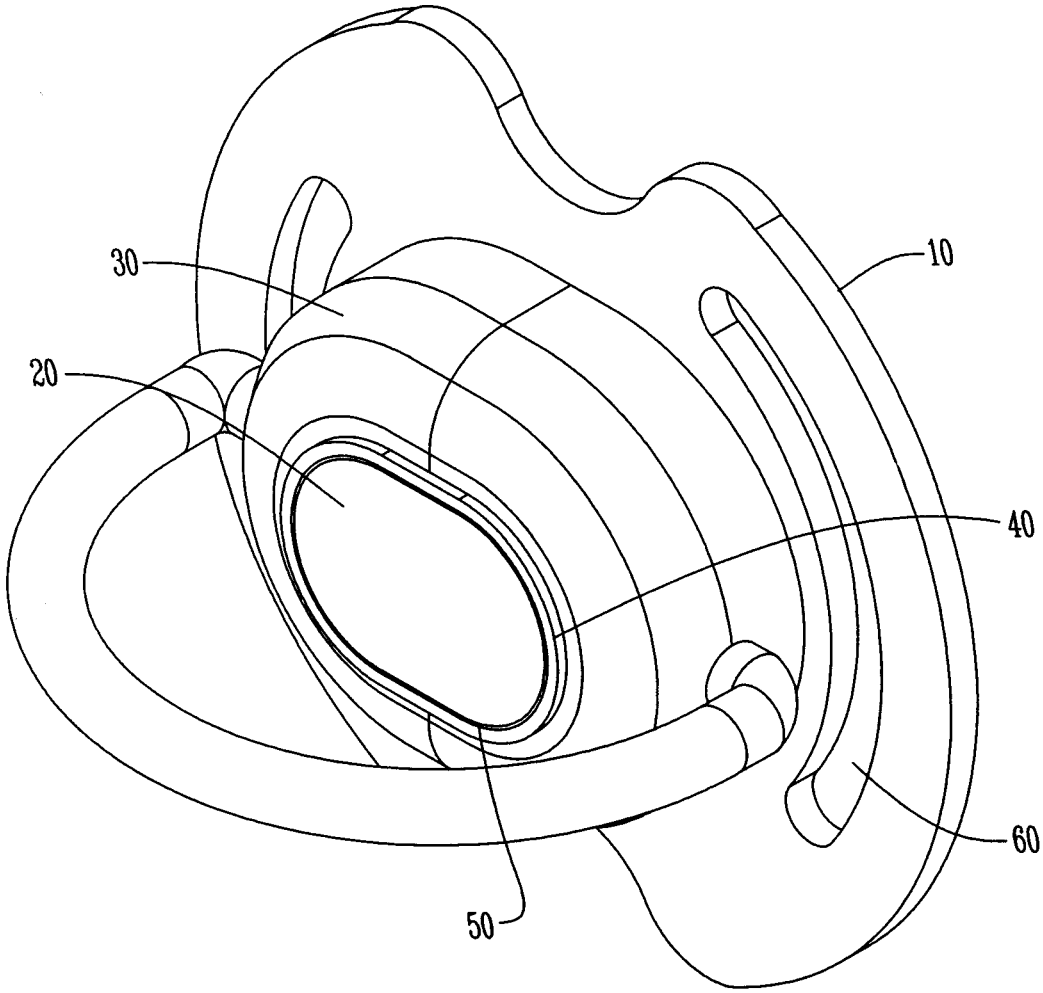
FIG. 1 shows a front view of the pacifier.

FIG. 1 shows a front view of the pacifier base 10. The mood stone 20 consists of a mood indicating substance produced commercially for such products as Mood Rings. The mood stone 20 is featured on the front of the pacifier base 10, mounted on an optional raised middle section 30. The mood stone 20 may be held within an optional metal frame 40, which helps conduct heat to the mood stone 20. An optional metal strip 50 is shown extending through the entire pacifier base 10, and is in contact with the metal frame 40 around the mood stone 20. The metal strip 50 may be flush with the pacifier base 10, or may be attached to the pacifier base 10 via glue or other adhesive means. The mood stone 20 is attached to the metal strip 50, if present, and the raised middle section 30, if present, or directly to the pacifier base 10 via glue or other adhesive means. Air holes 60 allow the child to suck on the pacifier effectively. The pacifier base 10 and the raised middle section 30 are made of a hard, durable material, such as plastic, and are connected via molding, glue, or other adhesive means.

Figure 2:
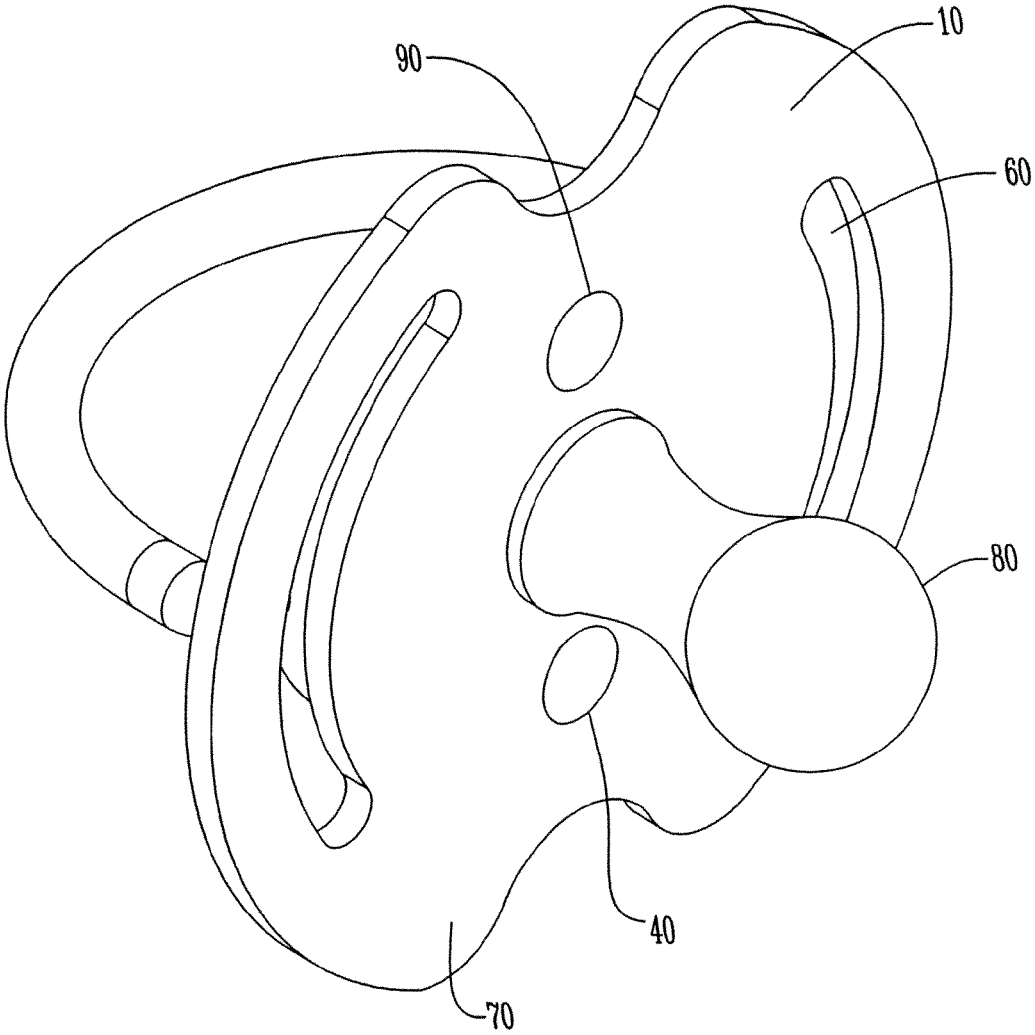
FIG. 2 shows a back view of the invention.

FIG. 2 shows a back view of the pacifier base 10. The nipple 80 protrudes from the center of the back 70 of the pacifier base 10, and is connected via molding, glue, or other adhesive means. The metal strip 50, if present, extends around the back 70 of the pacifier base 10 and terminates next to the nipple 80 in one or more contact surfaces 90. The contact surface(s) 90 of the metal strip 50 may be placed in any position on the pacifier base 70 as long as it comes in contact with the child's mouth when the child is sucking on the nipple 80.

The mood stone 20 may be in any shape desired: round, square, rectangular, star, special shapes (e.g., animals, such as a butterfly with one or more mood stones in the wings or a bear with a mood stone in the belly, clowns, cartoon characters, etc.) or any other shape desired. The pacifier 10 may also be in any shape deemed to be appropriate for infant use and acceptance. For the purposes of this document, the standard shape of most pacifiers is used as an example.

Many features have been listed with particular configurations, options, and embodiments. Any one or more of the features described may be added to or combined with any of the other embodiments or other standard devices to create alternate combinations and embodiments.

Although the examples given include many specificities, they are intended as illustrative of only one possible embodiment of the invention. Other embodiments and modifications will, no doubt, occur to those skilled in the art. Thus, the examples given should only be interpreted as illustrations of some of the preferred embodiments of the invention, and the full scope of the invention should be determined by the appended claims and their legal equivalents.

We claim:

1. A pacifier, comprising:

a pacifier base having a front surface and a back surface, a temperature sensitive material that changes color with changes in temperature, said temperature sensitive material attached to said front surface of said pacifier base, a nipple protruding from said back surface of said pacifier base, and a heat conducting strip extending from said back surface of said pacifier base to said temperature sensitive material wherein the heat conducting strip carries body temperature heat from the back surface of said pacifier through the pacifier base to the temperature sensitive material.

2. The pacifier of claim 1, wherein said temperature sensitive material is a mood stone.

3. The pacifier of claim 1, wherein said temperature sensitive material is mounted in a raised section protruding from said front surface of said pacifier base.

4. The pacifier of claim 1 wherein said heat conducting strip forms a frame around said temperature sensitive material.

5. The pacifier of claim 1 wherein an end of said heat conducting strip ends in a contact point adjacent said nipple.

6. The pacifier of claim 1 wherein said heat conducting strip is split to form at least two ends that form a contact point located adjacent said nipple.

7. The pacifier of claim 1 wherein said heat conducting strip is metal.

8. The pacifier of claim 1, further comprising a metal frame extending around a perimeter of said temperature sensitive material.

9. The pacifier of claim 1 further comprising air holes extending through said pacifier base.

10. A pacifier, comprising:

a pacifier base having a front surface and a back surface, a temperature sensitive material that changes color with changes in temperature, a raised section protruding from said front surface of said pacifier base, said temperature sensitive material attached to said raised section, a metal frame extending around a perimeter of said temperature sensitive material, a metal strip extending from at least one contact point on said back surface of said pacifier base to said metal frame such that body temperature heat is conducted through the pacifier base and carried from said at least one contact point on said back surface of said pacifier base to said temperature sensitive material, and a nipple protruding from said back surface of said pacifier base adjacent said at least one contact point.

11. The pacifier of claim 10, wherein said temperature sensitive material is a mood stone.

12. The pacifier of claim 10, further comprising air holes extending through said pacifier base.

13. The pacifier of claim 10, wherein said at least one contact point is at least two contact points.

* * * * *